United States Patent [19]

Morigami

[11] Patent Number: 4,999,567

[45] Date of Patent: Mar. 12, 1991

[54] CONSTANT CURRENT CIRCUIT

[75] Inventor: Takashi Morigami, Tokyo, Japan

[73] Assignee: NEC Corporation, Tokyo, Japan

[21] Appl. No.: 453,303

[22] Filed: Dec. 20, 1989

[30] Foreign Application Priority Data

Dec. 21, 1988 [JP] Japan ..... 63-324176

[51] Int. Cl.[5] ..... G05F 3/26

[52] U.S. Cl. ..... 323/315

[58] Field of Search ..... 323/313, 314, 315

[56] References Cited

U.S. PATENT DOCUMENTS 4,287,438 9/1981 Cave et al. ..... 323/315

4,906,914 3/1990 Ohsawa ..... 323/314

FOREIGN PATENT DOCUMENTS 2247537 9/1977 Fed. Rep. of Germany ..... 323/315

0062926 10/1984 Japan ..... 323/315

2108796 5/1983 United Kingdom ..... 323/315

*Primary Examiner*—William H. Beha, Jr.

*Assistant Examiner*—Nilay H. Vyas, Jr.

*Attorney, Agent, or Firm*—Helfgott & Karas

[57] ABSTRACT

First and second MOS transistors are connected through a first resistance to each other in series between first and second potentials. Third and fourth MOS transistors are connected in series between the first and second potentials. Gates of the first and third MOS transistors are commonly connected to each other, and connected to a drain of the third MOS transistor. A diode, a Zener diode, and a second resistance are connected in series between the first and second potentials, such that cathodes of the diode and the Zener diode are connected to each other. A constant voltage generated at a connecting point between the second resistance and the serial connection of the diode and the Zener diode is applied to a gate of the fourth MOS transistor. A constant current circuit thus obtained operates with a low voltage and is adapted to be connected even to a comparator having a large dependency on the threshold voltages.

7 Claims, 3 Drawing Sheets

CONSTANT CURRENT CIRCUIT

FIELD OF THE INVENTION

This invention relates to a constant current circuit, and more particularly to, a constant current circuit having stable voltage dependency and temperature dependency even in a low voltage operation.

BACKGROUND OF THE INVENTION

One type of a conventional constant current circuit comprises a starter circuit and a constant current generating circuit. The starter circuit includes, for instance, first to third P-MOS transistors and first to third N-MOS transistors. In the starter circuit, the first and second P-MOS transistors are connected at sources to a power supply, and at gates to each other, and the first N-MOS transistor is connected at a drain and a gate to a drain of the first P-MOS transistor. The second N-MOS transistor is connected at a drain to a source of the first N-MOS transistor, and at a gate to the drain of the first P-MOS transistor. Furtheremore, the third N-MOS transistor is connected at a drain to a drain of the second P-MOS transistor, and at a source to the ground potential along with a source of the second N-MOS transistor and a drain of the third P-MOS transistor. The third P-MOS transistor is connected at a gate to the drains of the first P-MOS and N-MOS transistors, and at a source to the constant current generating circuit. The constant current generating circuit includes first and second diodes, first and second P-MOS transistors, first and second N-MOS transistors, and a resistance for deciding a circuit current. In the constant current generating circuit, the first and second diodes are connected at anodes to the power supply, and the first and second P-MOS transistors are connected at sources to a cathode of the first diode and through the resistance to a cathode of the second diode, respectively, and at gates to each other. Furthermore, the first and second N-MOS transistors are connected at drains to drains of the first and second P-MOS transistors, respectively, at gates to each other, and at sources to the ground potential.

In operation, when a voltage of the power supply is risen, the first and second P-MOS transistors are first turned on in the starter circuit, and the first and second N-MOS transistors are then turned on therein. Then, the third P-MOS transistor is turned on in the starter circuit to drive the first and second P-MOS transistors in the constant current generating circuit. Thus, the first and second N-MOS transistors are turned on in the constant current generating circuit, so that a constant current is supplied from a common connecting point of the drains of the first P-MOS and N-MOS transistors and the gates of the first and second N-MOS transistors. A value I of the constant current is defined by an equation (1), $$I=(V_{D1}-V_{D2})/R \quad (1)$$

Where $V_{D1}$ is a voltage drop across the first diode, $V_{D2}$ is a voltage drop across the second diode, an R is a value of the resistance.

Where the constant current I is supplied to a gate of the third N-MOS transistor in the starter circuit, a different value of a constant current is obtained from a connecting point of the drains of the second P-MOS transistor and the third N-MOS transistor.

However, the conventional constant current circuit has a disadvantage in that a starting voltage of operation is large, because the second diode, the resistance, the first P-MOS transistor, and the first N-MOS transistor are connected in series between the power supply and the ground potential in the constant current generating circuit.

Another type of a conventional constant current circuit comprises a P-MOS transistor, a serial connection of a diode and a Zener diode, first and second N-MOS transistors, and a load resistance. In the constant current circuit, the P-MOS transistor is connected at a source to a power supply, and at a drain and a gate to each other, and the diode is connected at an anode to the drain and the gate of the P-MOS transistor, and at a cathode to a cathode of the Zener diode which is connected at an anode to the ground potential. Furthermore, the first N-MOS transistor is connected at a drain to the power supply, at a gate to the gate and the drain of the P-MOS transistor and the cathode of the diode, and at a source through the load resistance to a drain and a gate of the second N-MOS transistor which is connected at a source to the ground potential.

In operation, when a voltage of the power supply is risen, the P-MOS transistor is turned on, so that a constant voltage of approximately 7.5 ±0.3 V is obtained across the serial connection of the diode and the zener diode. The constant voltage is applied to the gate of the first N-MOS transistor, so that a constant current is supplied from a connecting point of the load resistance and the drain and the gate of the second N-MOS transistor.

However, the latter conventional constant current circuit has also a disadvantage in that this circuit can not be adapted to a circuit comprising a comparator, a characteristic of which depends largely on a balance of threshold voltage values of P- and N-MOS transistors included therein, because a constant current characteristic depends solely on threshold voltage values of N-channel transistors due to the circuit structure including the first and second N-MOS transistors and the load resistance, in which a constant current is decided.

SUMMARY OF THE INVENTION

Accordingly, it is an object of this invention to provide a constant current circuit in which a starting voltage of operation is lowered.

It is a second object of this invention to provide a constant current circuit which is connectable even to a comparator depending largely on a balance of threshold voltage values of P- and N- channel transistors.

According to this invention, a constant current circuit, comprises:

a power supply for providing a predetermined voltage;

a first circuit for generating a constant voltage in an application of said predetermined voltage thereto;

a second circuit through which a first current flows in an application of said predetermined voltage thereto, said standard current varying in accordance with said constant voltage;

a third circuit through which a second current flows in an application of said predetermined voltage thereto proportionally to said first current; and an output terminal from which a constant current is supplied in accordance with said second current.

BRIEF DESCRIPTION OF THE DRAWINGS

This invention will be explained in more detail in conjunction with appended drawings, wherein.

DETAILED DESCRIPTION OF THE PREFERRED EMBODIMENTS

Before explaining a constant current circuit in a preferred embodiment according to the invention, the two types of the aforementioned conventional constant current circuit will be briefly explained.

Figure 1A:
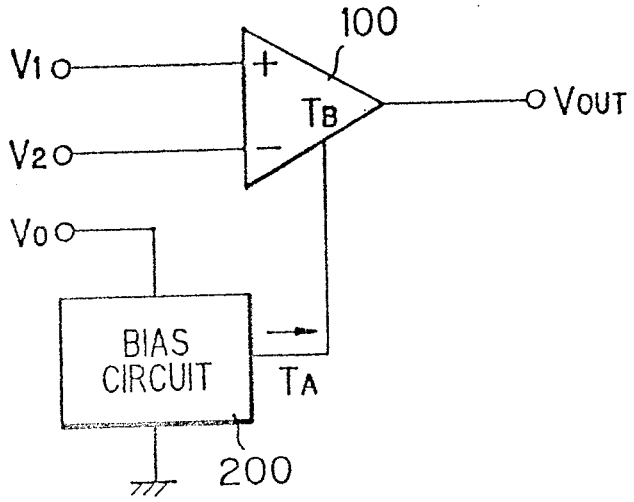
FIG. 1A PRIOR ART
FIG. 1A is a block diagram showing a connection of a constant current circuit and a comparator.

FIG. 1A shows a circuit including a comparater 100 and a constant current circuit 200 which functions as a bias current circuit. The comparator 100 has a positive input terminal to which a first analog voltage $V_1$ is applied, a negative input terminal to which a second analog voltage $V_2$ is applied, and an output terminal from which a logic high level is supplied when the first voltage $V_1$ is higher than the second voltage $V_2$, and a logic low level is supplied when the first voltage $V_1$ is lower than the second voltage $V_2$. The constant current circuit 200 supplies a constant current from a bias output terminal $T_A$ to a bias input terminal $T_B$ of the comparator 100 in the state that a voltage Vo is applied thereto.

Figure 1B:
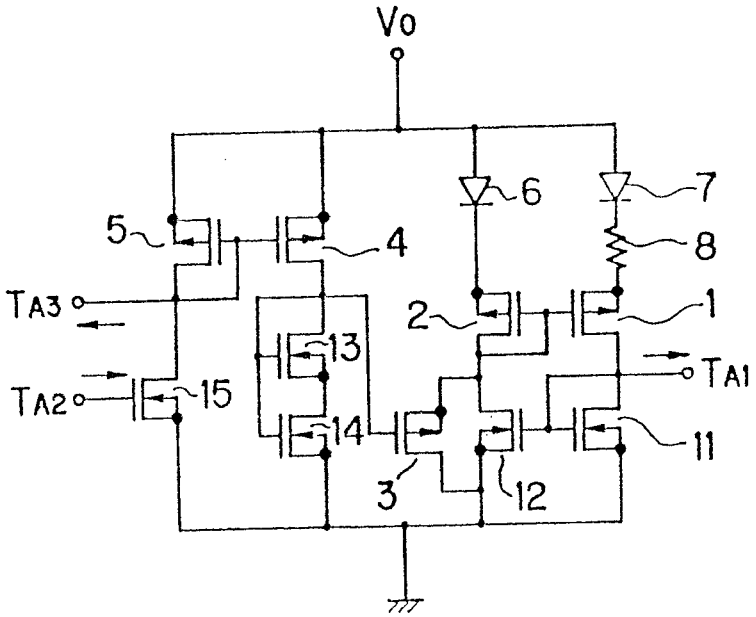
FIG. 1B PRIOR ART
FIG. 1B is a circuitry diagram showing a conventional constant current circuit.

FIG. 1B shows the former type of the aforementioned conventional constant current circuits. The constant current circuit comprises the starter circuit including the first to third P-MOS transistors 4, 5 and 3, and the first to third N-MOS transistor 13, 14 and 15, and the constant current generating circuit including the first and second diodes 6 and 7, the resistance 8, the first and second P-MOS transistors 1 and 2, and the first and second N-MOS transistors 11 and 12. In the constant current circuit, the voltage Vo of the power supply is applied to the sources of the first and second P-MOS transistors 4 and 5 in the starter circuit, and the anodes of the first and second diodes 6 and 7 in the constant current generating circuit, while the ground potential is applied to the sources of the second and third N-MOS transistors 14 and 15 and the drain of the third P-MOS transistor 3 in the starter circuit, and the sources of the first and second N-MOS transistors 11 and 12 in the constant current generating circuit, so that a first constant current is supplied from a first output terminal $T_{A1}$, and a second constant current is supplied from a second output terminal $T_{A3}$ upon the supplying of the first constant current to an input terminal $T_{A2}$. Detailed operation and disadvantage are not explained here, because they are explained before.

Figure 2:
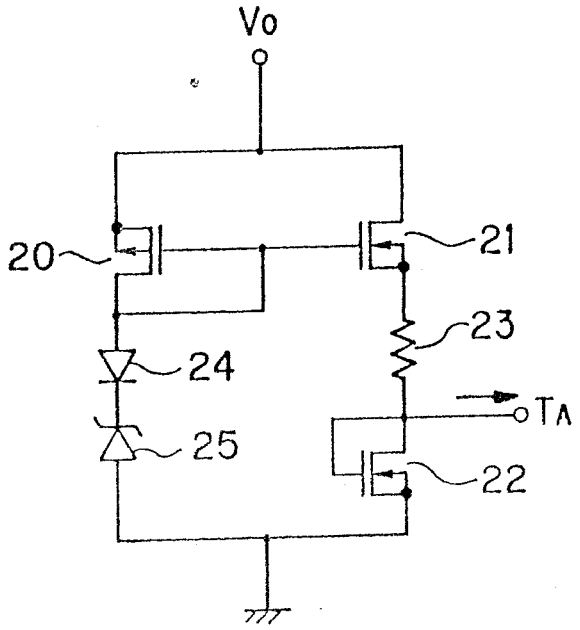
FIG. 2 PRIOR ART
FIG. 2 is a circuitry diagram showing another conventional constant current circuit.

FIG. 2 shows the latter type of the aforementioned conventional constant current circuits. The constant current circuit comprises the P-MOS transistor 20, the first and second N-MOS transistors 21 and 22, the load resistance 23, the diode 24, and the Zener diode 25. In the constant current circuit, the voltage Vo of the power supply is applied to the source of the P-MOS transistor 20 and the drain of the N-MOS transistor 21, and the ground potential is applied to the anode of the Zener diode 25 and the source of the second N-MOS transistor 22, so that a constant current is supplied from an output terminal $T_A$. Detailed operation and disadvantage of the constant current circuit are not explained here, because they are explained before.

Figure 3A:
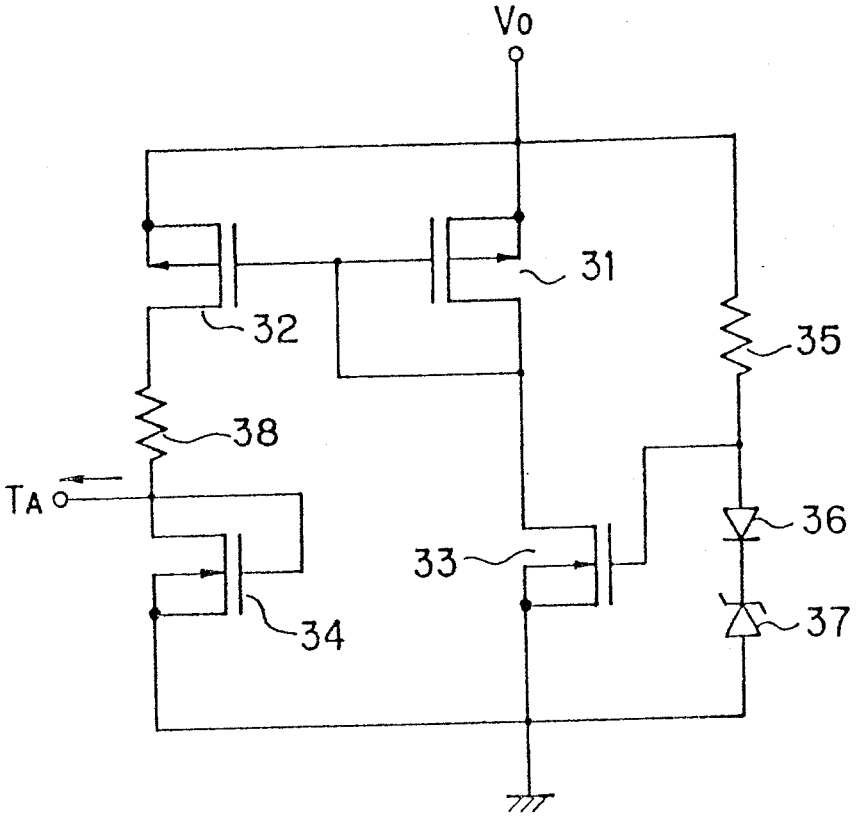
FIG. 3A is a circuitry diagram showing a constant current circuit in a first preferred embodiment according to the invention.

Next, a constant current circuit in the first preferred embodiment according to the invention will be explained in FIG. 3A.

The constant current circuit comprises first and second P-MOS transistors 31 and 32, first and second N-MOS transistors 33 and 34, first and second resistance 35 and 38, a diode 36, and a zener diode 37. In the constant current circuit, the first and second P-MOS transistors 31 and 32 are connected at sources to a power supply Vo, and at gates to each other, and the gate of the first P-MOS transistor 31 is connected to a drain thereof, so that a current mirror circuit is provided therein. The first P-MOS transistor 31 is connected at the gate and the drain to a drain of the first N-MOS transistor 33, to a gate of which an anode of the diode 36 is connected. The diode 36 is connected at the anode through the resistance 35 to the power supply Vo and at a cathode to a cathode of the Zener diode 37, an anode of which is connected to the ground, so that a stable constant voltage circuit is provided to apply a voltage of approximately (7.5±0.3) V to the gate of the first N-MOS transistor 33 by the serial connection of the diode 36 and the Zener diode 37. The diode 36 and the Zener diode 37 have a stable temperature property in the value of −2 mV/°C. and 2 to 4 mV/°C., respectively, and the first resistance 35 has a resistance value of approximately 100 kΩ for restricting a current flowing therethrough. The second P-MOS transistor 32 is connected at a drain through the second resistance 38 to a gate and a drain of the second N-MOS transistor 34 and a constant current output terminal $T_A$, and the first and second N-MOS transistors 33 and 34 are connected at sources to the ground.

In operation, when a voltage of the power supply Vo is increased, the first and second P-MOS transistors 31 and 32 are turned on, and the first and second transistors 33 and 34 are then turned on, wherein a constant voltage generated by the serial connection of the diode 36 and the Zener diode 37 is applied to the gate of the first N-MOS transistor 33, so that a dark current (leakage current) of the constant current circuit is decided in accordance with a width and a length of a substrate of the first N-MOS transitor 33. As a result, a current which is the same value as the dark current flows through the second resistance 38 and the second N-MOS transistor 34, because the first and second P-MOS transistors 31 and 32 provide a current mirror circuit. Consequently, a current which is stable with respect to voltage and temperature is supplied from the output terminal $T_A$. In particular, the output current is most stable, where the applied voltage is over 8 V.

Figure 3B:
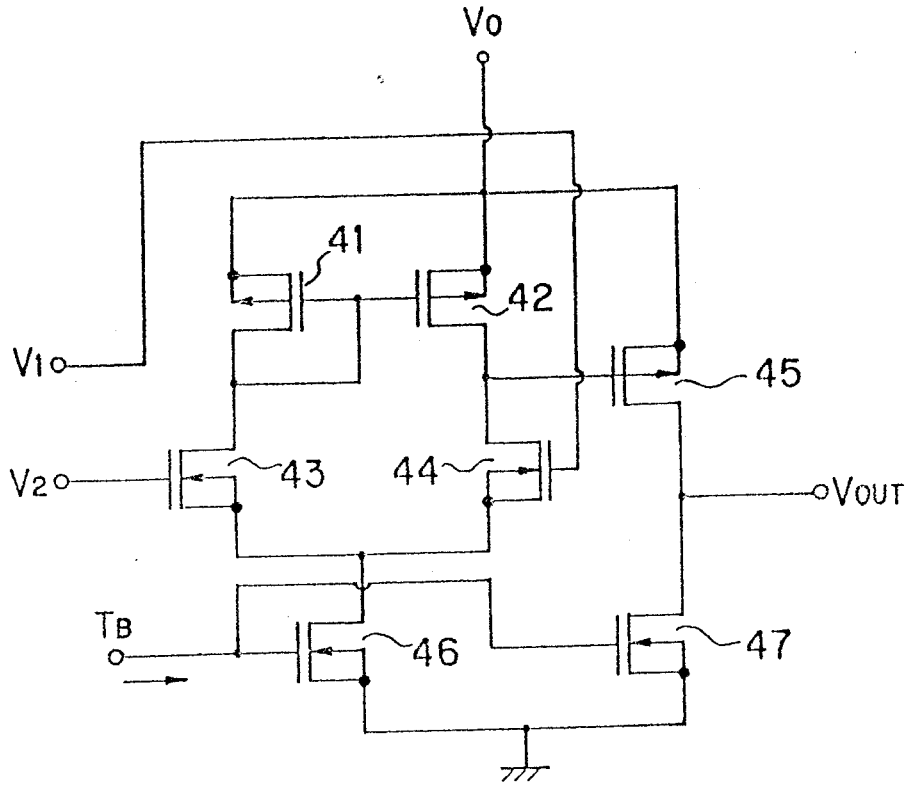
FIG. 3B is a circuitry diagram showing a comparator, to which the constant current circuit in the first preferred embodiment is connected.

FIG. 3B shows a comparator, to a bias terminal $T_B$ of which the constant current of the constant current circuit is supplied. The comparator comprises first and second P-MOS transistors 41 and 42, first and second N-MOS transistors 43 and 44, a third P-MOS transistor 45, and third and fourth N-MOS transistors 46 and 47.

In the comparator, a positive input terminal to which a first analog voltage is applied is connected to a gate of the second N-MOS transistor 44, and a negative input terminal to which a second analog voltage is applied is connected to a gate of the first N-MOS transistor 43. The constant current supplied from the output terminal $T_A$ of the constant current circuit as shown in FIG. 3A is supplied to a bias current input terminal $T_B$ connected to gates of the third and fourth N-MOS transistors 46 and 47. Furthermore, a voltage of a power supply Vo is applied to sources of the first to third P-MOS transistors 41, 42 and 45, and the ground potential is applied to sources of the third and fourth N-MOS transistors 46 and 47. To a connecting point of drains of the third P-MOS transistor 45 and the N-MOS transistor 47, an output terminal is connected to provide an output signal Vout of "high" or "low".

In operation, where the input voltages $V_1$ and $V_2$ ($V_1 > V_2$) are applied to the gates of the second and first N-MOS transistors 44 and 43, respectively, the second N-MOS transistor 44 is turned on, while the first N-MOS transistor 43 remains in the off-state, so that the third P-MOS transistor 45 is turned on. As a result, a logic level of "high" is obtained as the output signal Vout at the output terminal. On the other hand, where the input voltage $V_1$ and $V_2$ ($V_1 < V_2$) are applied to the gates of the second and first N-MOS transistors 44 and 43, respectively, the second N-MOS transistor 43 is turned on, while the first N-MOS transistor 44 remains in the off-state, so that the third P-MOS transistor 45 remains in the off-state. As a result, a logic level of "low" is obtained as the output signal Vout at the output terminal. In the above operation, the third and fourth N-MOS transistors 46 and 47 are turned on in accordance with the bias current supplied to the bias turminal $T_B$.

Figure 4:
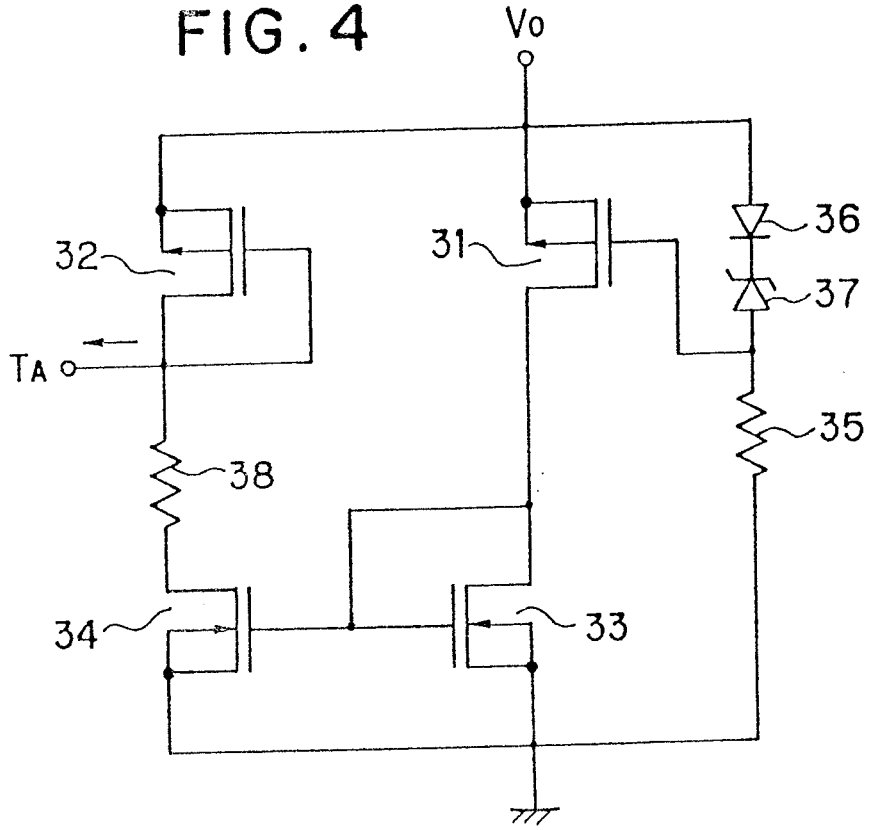
FIG. 4 is a circuitry diagram showing a constant current circuit in a second preferred embodiment according to the invention.

FIG. 4 shows a constant current circuit in the second preferred embodiment according to the invention, wherein like parts are indicated by like reference numerals, except that a current mirror circuit is provided by the first and second N-MOS transistors 33 and 34, a serial connection of the diode 36 and the Zener diode 37 is connected across the source and the gate of the first P-MOS transistor 31, and the output terminal $T_A$ is connected to a connecting point of the drain and the gate of the second P-MOS transistor 32 and the load resistance 38. The constant current circuit in the second preferred embodiment is adapted to be conected to a P-type of a comparator, although the constant circuit in the first preferred embodiment was connected to an N-type of a comparator.

In this invention, a constant current circuit operates with a low voltage, and is adapted to be connected to a comparator having a large independency on a threshold voltage, because a constant current output varies with a balance of threshold voltages of P- and N- channel transistors. Furthermore, a diode and zener diode are used to generate a constant voltage, so that a stable characteristic is obtained at a voltage of more than 8 V across the diode and the zener diode in an entire temparature range.

Although the invention has been described with respect to specific embodiment for complete and clear disclosure, the appended claims are not to be thus limited but are to be construed as embodying all modification and alternative constructions that may occur to one skilled in the art which fairly fall within the basic teaching herein set forth.

What is claimed is:

1. A constant current circuit, comprising:

a power supply for providing a predetermined voltage;

a first circuit for generating a constant voltage in an application of said predetermined voltage thereto;

a second circuit through which a first current flows in an application of said predetermined voltage thereto, said first current varying in accordance with said constant voltage;

a third circuit through which a second current flows in an application of said predetermined voltage thereto proportionally to said first current; and an output terminal from which a constant current is supplied in accordance with said second current, wherein:

said first circuit includes a first resistance, a diode, and a Zener diode connected in series, such that a first terminal of said first resistance is connected to a higher potential of said power supply, a second terminal of said first resistance is connected to an anode of said diode, a cathode of said diode is connected to a cathode of said Zener diode, and an anode of said Zener diode is connected to a lower potential of said power supply, said constant voltage being generated at said anode of said diode;

said second circuit includes a P-MOS transistor and an N-MOS transistor connected in series, such that a source of said P-MOS transistor is connected to said higher potential, a gate and a drain of said P-MOS transistor are connected to each other, to a drain of said N-MOS transistor, and to said third circuit, a gate of said N-MOS transistor is connected to said anode of said diode, and a source of said N-MOS transistor is connected to said lower potential; and said third circuit includes a P-MOS transistor, a second resistance, and an N-MOS transistor connected in series, such that a source of said P-MOS transistor is connected to said higher potential, a gate of said P-MOS transistor is connected to said gate and said drain of said P-MOS transistor of said second circuit, a drain of said P-MOS transistor is connected to a first terminal of said second resistance, a second terminal of said second resistance is connected to a drain and a gate of said N-MOS transistor and said output terminal, and a source of said N-MOS transistor is connected to said lower potential.

2. A constant current circuit, comprising:

a power supply for providing a predetermined voltage;

a first circuit for generating a constant voltage in an application of said predetermined voltage thereto;

a second circuit through which a first current flows in an application of said predetermined voltage thereto, said first current varying in accordance with said constant voltage;

a third circuit through which a second current flows in an application of said predetermined voltage thereto proportionally to said first current; and an output terminal from which a constant current is supplied in accordance with said second current, wherein:

said first circuit includes a diode, a Zener diode and a first resistance connected in series, such that a first terminal of said first resistance is connected to a lower potential of said power supply, a second terminal of said resistance is connected to an anode of said Zener diode, a cathode of said Zener diode is connected to a cathode of said diode, and an anode of said diode is connected to a higher potential of said power supply, said constant voltage being generated at said anode of said Zener diode;

said second circuit includes an N-MOS transistor and a P-MOS transistor connected in series, such that a source of said N-MOS transistor is connected to said lower potential, a gate and a drain of said N-MOS transistor are connected to each other, to a drain of said P-MOS transistor, and to said third circuit, a gate of said P-MOS transistor is connected to said anode of said Zener diode, and a source of said P-MOS transistor is connected to said higher potential; and said third circuit includes an N-MOS transistor, a second resistance, and a P-MOS transistor connected in series, such that a source of said N-MOS transistor is connected to said lower potential, a gate of said N-MOS transistor is connected to said gate and said drain of said N-MOS transistor of said second circuit, a drain of said N-MOS transistor is connected to a first terminal of said second resistance, a second terminal of said second resistance is connected to a drain and a gate of said P-MOS transistor and said output terminal, and a source of said P-MOS transistor is connected to said higher potential.

3. A constant current circuit, according to claim 1, further comprising:

a comparator connected to said output terminal, said comparator having a characteristic depending largely on a balance of threshold voltages of P- and N-channel transistors.

4. A constant current circuit, according to claim 3, wherein:

said comparator comprises:

first and second N-MOS transistors, to which said output terminal is connected;

first and second P-MOS transistors, to which an operation voltage is applied;

third P-MOS transistor, to which an output of said comparator is connected;

third and fourth N-MOS transistors, to which first and second input signals to be compared to each other are applied.

5. A constant current circuit, according to claim 2, further comprising:

a comparator connected to said output terminal, said comparator having a characteristic depending largely on a balance of threshold voltages of P- and N-channel transistors.

6. A constant current circuit, according to claim 5, wherein:

said comparator comprises:

first and second P-MOS transistors, to which said output terminal is connected;

first and second N-MOS transistors, to which an operation voltage is applied;

third P-MOS transistor, to which an output of said comparator is connected;

third and fourth N-MOS transistors, to which first and second input signals to be compared to each other are applied.

7. A constant current circuit, comprising:

a power supply for providing a predetermined voltage;

a first circuit for generating a constant voltage in an application of said predetermined voltage thereto;

a second circuit through which a first current flows in an application of said predetermined voltage thereto, said first current varying in accordance with said constant voltage;

a third circuit through which a second current flows in an application of said predetermined voltage thereto proportionally to said first current; and an output terminal from which a constant current is supplied in accordance with said second current, wherein:

said second circuit includes a P-MOS transistor and an N-MOS transistor connected in series, such that a source of said P-MOS transistor is connected to a higher potential of said power supply, a gate and a drain of said P-MOS transistor are connected to each other, to a drain of said N-MOS transistor, and to said third circuit, a gate of said N-MOS transistor is connected to said first circuit, and a source of said N-MOS transistor is connected to a lower potential of said power supply; and said third circuit includes a P-MOS transistor, a resistance, and an N-MOS transistor connected in series, such that a source of said P-MOS transistor is connected to said higher potential, a gate of P-MOS transistor is connected to said gate and said drain of said P-MOS transistor of said second circuit, a drain of said P-MOS transistor is connected to a first terminal of said resistance, a second terminal of said resistance is connected to a drain and a gate of said N-MOS transistor and said output terminal, and a source of said N-MOS transistor is connected to said lower potential.

* * * * *